United States Patent [19]

Harasek

[11] Patent Number: 4,925,501

[45] Date of Patent: May 15, 1990

[54] EXPOLOSIVE COMPACTION OF RARE EARTH-TRANSITION METAL ALLOYS IN A FLUID MEDIUM

[75] Inventor: Elizabeth F. Harasek, Franklin, Mich.

[73] Assignee: General Motors Corporation, Detroit, Mich.

[21] Appl. No.: 163,557

[22] Filed: Mar. 3, 1988

[51] Int. Cl.[5] ..... H01F 1/04

[52] U.S. Cl. ..... 148/101; 148/104; 264/84; 419/66

[58] Field of Search ..... 148/101, 104; 419/66; 264/84

[56] References Cited

U.S. PATENT DOCUMENTS 3,023,462 3/1962 Taylor et al. ..... 419/49
3,220,103 11/1965 Simons ..... 264/84
4,792,367 12/1988 Lee ..... 148/104
4,802,931 7/1989 Croat ..... 148/302

FOREIGN PATENT DOCUMENTS 162750 8/1985 Japan .

OTHER PUBLICATIONS

"Explosive Forming," *American Machinist*, pp. 127–138, Jun. 15, 1959.

Metals Handbook, Eighth Edition, vol. 4, pp. 250–255.

*Primary Examiner*—L. Dewayne Rutledge
*Assistant Examiner*—George Wyszomierski
*Attorney, Agent, or Firm*—Lawrence B. Plant

[57] ABSTRACT

This invention relates to a method of making large, fully dense compacts of substantially amorphous to very finely crystalline rare earth alloys using explosive compaction and hot working.

3 Claims, 2 Drawing Sheets

4 figs

EXPOLOSIVE COMPACTION OF RARE EARTH-TRANSITION METAL ALLOYS IN A FLUID MEDIUM

This invention relates to explosive compaction of rare earth-transition metal particles with a fluid medium to make fully dense compacts having anisotropic properties. More particularly, this invention relates to explosive compaction and extrusion of very finely crystalline, light rare earth-transition metal-boron based alloys to make magnetically anisotropic permanent magnets

BACKGROUND

Permanent magnets based on compositions containing iron, neodymium and/or praseodymium, and boron are now in commercial usage. These magnets contain grains of tetragonal crystals in which the proportions of transition metal (TM), rare earth (RE), and boron are exemplified by the empirical formula $RE_2TM_{14}B_1$ and where at least part of the transition metal is iron. These magnet compositions and methods of making them are described in U.S. Ser. No. 414,936, filed September 3, 1982, and U.S. Ser. No. 544,728, filed October 26, 1983, both assigned to the assignee of this application and incorporated herein by reference. The grains of the tetragonal crystal phase are surrounded by a small amount of a second phase that is typically rare earth rich and lower melting compared to the principal phase.

A preferred method of making magnets based on these compositions is the rapid solidification of an alloy from a melt to produce very fine grained, magnetically isotropic particles. Melt spinning or jet casting is an efficient method of producing rapidly solidified ribbon flakes which may be directly quenched to near optimum single magnetic domain size or overquenched and heated to promote suitable grain growth. The flakes can be ground to a convenient size for further processing.

It is also known that fine grained RE-TM-B particles can be hot pressed and/or hot worked and plastically deformed to form isotropic and anisotropic permanent magnets with exceptionally high energy products. This practice is described in U.S. Ser. No. 520,170, filed August 4, 1983, assigned to the assignee of this application and is incorporated herein by reference.

A typical hot processing practice entails overquenching an alloy of a preferred RE-TM-B composition such as $Nd_{0.13}(Fe_{0.95}B_{0.05})_{0.87}$. The thin, friable ribbon is then crushed or ground into particles of a convenient size for an intended hot pressing operation (50 –325 mesh, e.g.). Rapidly solidified ribbon particles are stable in air at room temperature. The particles are heated in a nonoxidizing atmosphere to a suitable elevated temperature, preferably about 650° C. or higher, and subjected to pressures high enough to achieve a magnetically isotropic, nearly full density compact or a magnetically anisotropic plastically deformed compact. U.S. Ser. No. 520,170teaches that processing may be accomplished by hot pressing in a die, extrusion, rolling, die upsetting, hammering or forging, for example. Hot isostatic pressing is useful to make fully dense isotropic magnets, but has a slow cycle time.

These processes are all useful to form moderately sized magnets into simple shapes. This application relates particularly to a novel method of hot forming and/or hot working rare earth-transition metal powders or compacts to make relatively large permanent magnets with consistent densities and magnetic properties.

Such large magnets could be economically cut into smaller shapes or used for applications where several magnets must otherwise be pieced together with some sacrifice of magnetic properties.

As used herein, the term "working" shall mean the application of heat and pressure to a workpiece to cause material flow therein which induces magnetic anisotropy in substantially amorphous to very finely crystalline RE-TM-B alloys. The term "forming" shall mean the application of heat and pressure to a workpiece to cause consolidation thereof and may or may not include working.

SUMMARY OF THE INVENTION

In accordance with a preferred practice of the subject invention, suitable $RE_2TM_{14}B_1$ based alloy particles with a substantially amorphous to very finely crystalline microstructure are disposed in a thin-walled container which is flexible at explosive forming conditions. The particles and container together comprise a workpiece for explosive compaction and working.

The workpiece is positioned into a die cavity in a sealing relationship between first and second die portions. The first die portion contains a medium which is a substantially incompressible fluid at forming temperatures and an explosive forming charge. The second die portion is empty so that the workpiece can extrude into it when the explosive is detonated.

The workpiece and compression medium are preferably heated to a temperature at which the relatively brittle alloy RE-TM-B is malleable but at which there is no appreciable grain growth. This is generally at a temperature above about 650° C. but below about 800° C. Compaction and working are accomplished by detonating the explosive charge in the medium. This causes a very high pressure to be exerted on the workpiece which in turn causes it to flow along the path of least resistance into the erstwhiles empty portion of the die cavity. The result is substantial orientation of the grains in the explosively compacted particles and magnetic anisotropy therein.

DETAILED DESCRIPTION

The invention will be better understood in view of the figures and the detailed description which follows. In the Figures.

In general, preferred RE-TM-B compositions of magnetic interest comprise, on an atomic percentage basis, 50–90% of iron or mixtures of cobalt and iron, 10–40% rare earth metal that necessarily includes neodymium and/or praseodymium and at least about one half percent boron. Preferably, iron makes up at least 40 atomic percent of the total composition, and neodymium and/or praseodymium make up at least 6 atomic percent of the total composition. The preferred boron content is in the range of from about 0.5 to about 10atomic percent for the total composition, but the total boron content may be substantially higher than this without unacceptable loss of permanent magnetic properties. It is preferred that iron make up at least 60% of the transition metal content, and it is also preferred that neodymium and/or praseodymium make up at least 60% of the rare earth content.

Permanently magnetic alloys of particular interest are those which contain a predominant $RE_2TM_{14}B_1$ phase. This phase tolerates the presence of substantial amounts of elements other than those mentioned above such as aluminum, silicon, phosphorous, gallium, and transition metals other than iron or iron and cobalt, without destruction of permanent magnetic properties. The presence of other elements may be used to tailor magnetic properties. For example, the addition of one or more heavy rare earth elements improves magnetic coercivity, and the addition of cobalt has been found to increase Curie temperatures.

Figure 1:
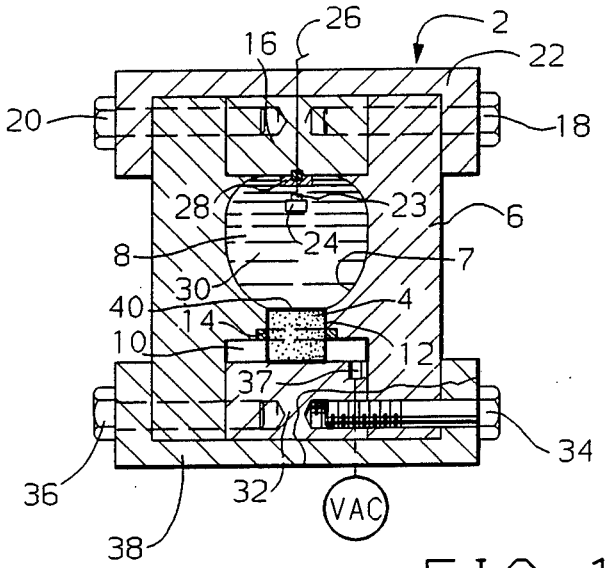
FIG. 1 shows an apparatus for explosively forming a disc-shaped magnet prior to detonation of the explosive charge.

In accordance with a preferred practice of the invention and with reference to FIG. 1, a bomb 2 is provided in which suitable RE-TM-B alloy particles 4 having a substantially amorphous to very finely crystalline microstructure are contained in a deformable container 12 preparatory to formation into a large, anisotropic permanent magnet.

Bomb 2 comprises cylindrical retaining wall 6. Inside diameter 7 of wall 4 defines a first chamber 8 and second chamber 10. RE-TM-B alloy particles 4 substantially fill container 12 which is located between chambers 8 and 10. Preferably, container 12 is sealed with respect to inside diameter 7 with a sealing member 14. If desired, container 12 and particles 4 can be replaced with a green or hot pressed compact (without a container) having sufficient strength to be positioned in a bomb without breaking.

First chamber 8 is covered by top sealing member 16. Member 16, and other surfaces of explosion chamber 8, preferably have rounded surfaces rather than sharp corners to eliminate the tendency of tooling materials to fracture at corners. Member 16 is held in place by bolts 18 and 20 which also secure cap-shaped top clamp 22. Explosive charge 24 and detonator cap 23 are located in First chamber 8 at some distance from container 12. Fuse 26 is threaded through sealing member 16 and clamp 22. A one-way seal 28 is located where the fuse goes through member 16 to prevent escape of materials through the conduit for the fuse when charge 24 is exploded. First chamber 8 is filled with a medium 30 which is a substantially incompressible fluid at explosive forming temperatures.

Second chamber 10 is covered by bottom sealing member 32. Member 32 is held in place by bolts 34 and 36 which also secure cap-shaped bottom clamp 38. A vacuum line 37 may be provided to evacuate chamber 10 to facilitate the flow of the workpiece comprised of container 12 and alloy 4 into It.

Preferred RE-TM-B alloys consolidate and flow best upon application of pressure at temperatures above about 650° C. but below the melting temperature of the principal phase of the alloy. Forming temperatures are most preferably in range of about 650° C. to 750° C. to prevent excessive grain growth. Therefore, it may be desirable to preheat bomb 2 to a temperature of about 650° C. before detonating the explosive 24. For rapidly solidified RE-TM-B alloys it is preferred that the grain size of the main phase does not exceed 400 nM to 800 nM.

Figure 2:
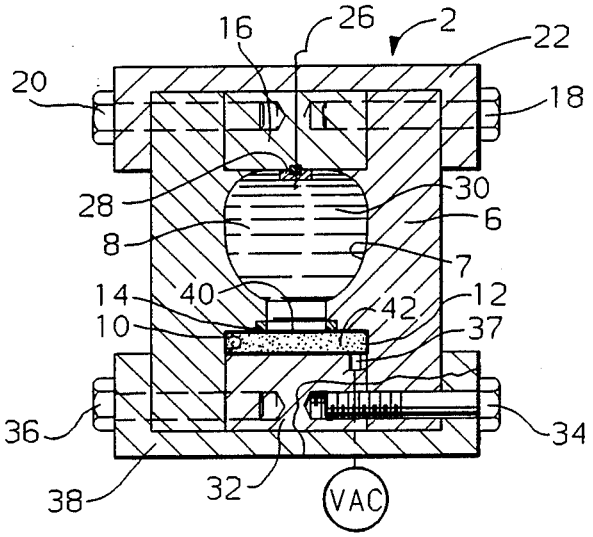
FIG. 2 shows the apparatus of FIG. 1 after the charge has been exploded and an anisotropic disc-shaped magnet has been formed.

To form a large, disk-shaped block of anisotropic alloy and with reference to FIG. 2, a suitable pulse is passed through fuse 26 and charge 24 is detonated by cap 23. The resultant explosion causes extremely high pressures to be transmitted through medium 30 onto the top surface 40 of container 12. This in turn causes alloy particles 4 to be fully compacted to substantially 100% of the theoretical alloy density and for the dense compact to extrude into second chamber 10.

A formed workpiece 42 of a RE-TM-B based composition as described herein would be magnetically anisotropic and have a preferred axis of magnetization normal to the direction of material flow during the explosive forming operation.

The subject method lends itself to making very large magnets which could weigh over 50 kg and be several centimeters thick. Such magnets would be difficult or impossible to form using conventional hot presses or forges due to practical forming tonnage limitations. It would also be difficult or impossible to make such magnets by the powder metal process (orient-press-sinter method) because the thermal history of such large parts would be internally inconsistent, magnetic properties irregular and such parts would probably crack during thermal cycling.

Figure 3:
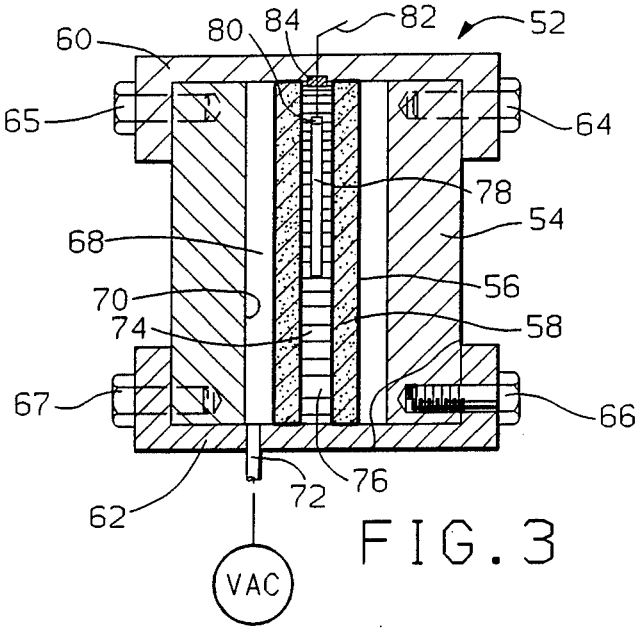
FIG. 3 shows an apparatus for explosively forming a tubular shaped magnet prior to detonation of the explosive charge.

In another embodiment and with reference to FIG. 3, a bomb 52 is shown suitable for explosively forming an axially magnetically oriented, cylindrical shaped RE-TM-B based magnet.

Bomb 52 comprises a cylindrical die 54 which is open on both ends. Die 54 is preferably split (not shown) to facilitate removal of a formed magnet. The top and bottom of die 54 are sealed with caps 60 and 62, respectively. Caps 60 and 62 are secured in place by bolts 64,65, 66 and 67.

A thin-walled cylindrical container 56 containing substantially amorphous to very finely crystalline alloy particles 58 is located in die cavity 68 concentric with die walls 70. A vacuum line 72 is provided between die walls 70 and container 56. Chamber 74 formed by container 56 contains a medium 76 which is fluid at explosive forming temperatures. As noted above, preferred forming temperatures for RE-TM-B alloys is about 650° C. to 750° C.

An explosive charge 78 is located in chamber 74. It is detonated by blasting cap 80 when a suitable signal is received through fuse 82. A seal 84 is provided where fuse 82 goes through cap 60 to prevent escape of material from the bomb.

Figure 4:
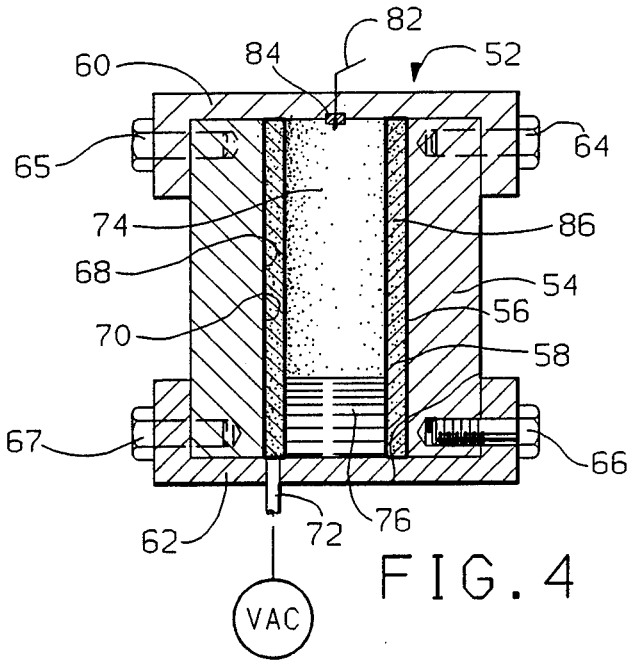
FIG. 4 shows the apparatus of FIG. 3 after the charge has been exploded and an anisotropic magnet has been formed.

Referring to FIGS. 3 and 4, to make a fully consolidated, anisotropic magnet body 86 (FIG. 4), charge 78 (FIG. 3) is detonated. The shock waves created force particles 58 to become full consolidated and stretched with container 56, against die walls 70. For Nd-Fe-B based alloys, for example, this results in a magnetically anisotropic body with a preferred direction of magnetic orientation in the axial direction of the cylinder. For the reasons set forth above, this, too, is the only known practical method of making large, axially oriented ring magnets. In fact, this could be the most practical method of making any large-size, non-segmented, axially aligned ring magnets. Ring extrusion of very fine grained alloys results in radial magnetic orientation.

In the practice of the subject invention, it is preferred that the magnets so created ultimately have an average grain size less than about 800 nM and preferably less than about 400 nM to optimize magnetic properties. It is believed that such small grain sizes are commensurate or smaller than single magnetic domain size. The subject method is particularly adapted to making magnets with controlled grain sizes because the actual compaction or working time is very short. The initial shock wave for high explosives is generally only a few milliseconds in duration and subsequent effective shock waves last only a short time longer. Quench of the formed magnets can be tailored to prevent grain growth and cracking of an explosively formed magnet. For example, a rapid quench to a temperature between about 600° and 650° C. could be followed by a slow cooling cycle to room temperature. A finished magnet can be annealed as desired to achieve optimum grain size for a particular application.

The Figures show the RE-TM-B alloy particles contained in a can. It is preferable that such can may be made of a material such as mild steel, stainless copper, tin, aluminum, nickel, glass or any other material which is plastic at forming temperatures. It would also be possible to use a cold or hot pressed compact of sufficient strength to be disposed in a bomb without breaking.

The Figures show a fluid medium surrounding the explosive charge. Suitable fluids could be water, oil, low melting alloys such as Cu-10Ni, or a glass which is molten at forming temperatures. While using a fluid medium is a preferred practice because the efficiency of an explosion is greater in a fluid medium, it would also be possible to form magnets using a gas or particulate solid medium. It would be within the skill of the art to choose appropriate combinations of explosives, blasting caps, detonating circuits and forming mediums for any particular application.

The Figures show confined explosive forming apparatuses. It would also be possible to practice the invention using an unconfined explosive forming system. In an unconfined system, the explosive is disposed in a large tank of fluid and the workpiece to be formed is held at the bottom of the tank. Detonation results in only a small portion of the energy released being used to form the magnet. Most of the energy is dissipated by shock waves sent traveling through the relatively large amount of fluid. However, where such a system is already available, its use could be preferable to the added expense of making bombs for confined explosive forming.

The die material for a bomb must be able to withstand the loading forces of the explosion and shock waves. A suitable material would be a heat treated alloy steel with a Rockwell C hardness less than about 50. Low carbon steels such as 1010 or 1020 may be useful. Plaster or concrete dies could be used for one-shot dies.

While the invention has been described particularly with respect to rare earth-iron based alloys, it can also be practiced to make rare earth-cobalt based alloy magnets. Such magnets could be comprised predominantly of $RE_1TM_5$ and $RE_2TM_{17}$phases, for example.

While my invention has been described in terms of specific embodiments thereof, other forms may be readily adapted by those skilled in the art. Therefore, the scope of my invention is to be limited only in accordance with the following claims.

The embodiments of the invention in which an exclusive property or privilege is claimed are defined as follows:

1. A method of making an alloy body comprising one or more rare earth metals including at least one of Nd, Pr and Sm, one or more transition metals including at least one of Co and Fe and optionally B, said method comprising dispersing particles of said alloy having an average crystal grain size less than about 400 nM in a container, providing a bomb comprising a confined chamber having first and second chamber portions, positioning said container in sealing relation between said first and second chamber portions, evacuating said second chamber portion, locating an explosive charge and a fluid in said first chamber portion, exploding said charge to cause consolidation of said particles to substantially full density and flow of said consolidated particles into said second chamber and annealing said consolidated body as necessary to arrive at a crystal structure commensurate with creation of permanent magnetic properties therein.

2. The method of claim 1 where the alloy consists predominatly of a $RE_2TM_{14}B_1$ phase.

3. The method of claim 1 where the alloy consists predominatly of a $RE_2TM_{17}$ or $RE_1TM_5$ phase.

* * * * *